US009132299B2

(12) United States Patent
Sutton et al.

(10) Patent No.: US 9,132,299 B2
(45) Date of Patent: Sep. 15, 2015

(54) RESPIRATOR HAVING AN INTEGRATED ORONASAL MASK

(75) Inventors: Robert Charles Sutton, Southport (GB); Grant Stuart Richardson, Salisbury (GB)

(73) Assignee: Scott Health & Safety Limited, Skelmersdale, Lancashire (GB)

( * ) Notice: Subject to any disclaimer, the term of this patent is extended or adjusted under 35 U.S.C. 154(b) by 1866 days.

(21) Appl. No.: 10/598,969

(22) PCT Filed: Mar. 17, 2005

(86) PCT No.: PCT/GB2005/050039

§ 371 (c)(1),
(2), (4) Date: Aug. 1, 2007

(87) PCT Pub. No.: WO2005/089876

PCT Pub. Date: Sep. 29, 2005

(65) Prior Publication Data

US 2007/0289592 A1 Dec. 20, 2007

(30) Foreign Application Priority Data

Mar. 19, 2004 (GB) ..... 0406291.5

(51) Int. Cl.

| | |
|---|---|
| ***A62B 18/02*** | (2006.01) |
| ***A62B 7/10*** | (2006.01) |
| ***A62B 23/02*** | (2006.01) |
| ***A62B 18/08*** | (2006.01) |

(52) U.S. Cl.

CPC . *A62B 18/02* (2013.01); *A62B 7/10* (2013.01); *A62B 18/08* (2013.01); *A62B 23/02* (2013.01)

(58) Field of Classification Search

CPC ..... A62B 18/02; A62B 18/06; A62B 18/08; A62B 23/00; A62B 23/02; A62B 7/10

USPC ..... 128/205.27–205.29, 206.11–206.19, 128/207.11, 207.17, 207.19, 204.17, 128/201.24, 201.15

See application file for complete search history.

(56) References Cited

U.S. PATENT DOCUMENTS

| | | | | | |
|---|---|---|---|---|---|
| 2,381,568 | A | * | 8/1945 | Booharin | 128/201.15 |
| 2,462,005 | A | * | 2/1949 | Schauweker | 128/207.11 |
| 2,810,386 | A | * | 10/1957 | Reed | 128/201.15 |
| 4,549,542 | A | * | 10/1985 | Chien | 128/201.24 |
| 4,590,951 | A | * | 5/1986 | O'Connor | 128/204.23 |
| 4,688,567 | A | * | 8/1987 | Kikuchi et al. | 128/206.15 |
| 4,945,907 | A | * | 8/1990 | Tayebi | 128/206.12 |
| 5,040,530 | A | * | 8/1991 | Bauer et al. | 128/206.12 |
| 5,140,980 | A | * | 8/1992 | Haughey et al. | 128/201.25 |
| 5,154,168 | A | * | 10/1992 | Schlobohm | 128/205.27 |

(Continued)

FOREIGN PATENT DOCUMENTS

| | | |
|---|---|---|
| DE | 17 08 046 | 4/1971 |
| WO | WO 03/068318 | 8/2003 |

*Primary Examiner* — Justine Yu
*Assistant Examiner* — Timothy Stanis
(74) *Attorney, Agent, or Firm* — Wyatt B. Pratt

(57) ABSTRACT

A respirator includes an outer mask defining a first volume. An oronasal mask defines a second volume. The oronasal mask is positioned within the first volume. A primary filter is affixed to the outer mask and a secondary filter is positioned within the first volume such that the secondary filter filters air traveling from the first volume to the second volume. The secondary filter filters air traveling around a portion of the second volume. The filters are arranged to filter either particles or vapors, or a mixture of these, as required.

16 Claims, 6 Drawing Sheets

(56) References Cited

U.S. PATENT DOCUMENTS

| | | | | | |
|---|---|---|---|---|---|
| 5,297,544 | A * | 3/1994 | May et al. | 128/202.22 |
| 5,323,774 | A * | 6/1994 | Fehlauer | 128/206.12 |
| 5,372,130 | A * | 12/1994 | Stern et al. | 128/205.25 |
| 5,694,925 | A * | 12/1997 | Reese et al. | 128/206.19 |
| 5,794,260 | A * | 8/1998 | Schegerin | 2/6.1 |
| 6,102,034 | A * | 8/2000 | Buhlmann | 128/201.29 |
| 6,176,239 | B1 * | 1/2001 | Grove et al. | 128/206.24 |
| 6,435,184 | B1 * | 8/2002 | Ho | 128/206.21 |
| 6,701,925 | B1 * | 3/2004 | Resnick | 128/206.17 |
| 6,978,782 | B2 * | 12/2005 | Tayebi | 128/206.19 |
| 7,013,891 | B2 * | 3/2006 | Richardson et al. | 128/201.15 |
| 7,089,931 | B2 * | 8/2006 | Bee | 128/201.28 |
| 7,261,104 | B2 * | 8/2007 | Kiefer et al. | 128/201.17 |

* cited by examiner

RESPIRATOR HAVING AN INTEGRATED ORONASAL MASK

This invention relates to respirators which may be worn to protect against the inhalation of harmful material present in the ambient air.

Respirators can take various forms, most commonly a mask, hood or suit and contains a number of elements intended to provide protection for the wearer. These include a filter to remove harmful material from the inhaled air stream and a one-way valve to allow exhaled air to exit the respirator, but prevent ambient air from entering the respirator. In addition, if the respirator is a mask or hood covering only part of the body, a seal is provided to prevent harmful material entering the respirator via its locus of contact with the wearer.

The most common types of respirator are as follows:—

1) A simple mask covering just the mouth and nose of the wearer. This type is referred to as an oronasal mask.

2) A full face mask enclosing the whole face of the wearer and incorporating a seal which engages around the periphery of the face and a visor to enable the wearer to see.

3) A hood which encloses the whole head of the wearer and incorporates a seal around the neck of the wearer and a visor to enable the wearer to see.

4) A protective suit which encloses the whole body of the wearer and a visor to enable the wearer to see.

The present invention is concerned with respirators of type 2, 3 or 4 above. In all cases, such respirators may additionally incorporate within them an oronasal mask (see item 1 above), or may be compartmentalised to define distinct chambers, one of which provides the functions of the oronasal mask. Either way, the oronasal mask, or chamber serving the function of an oronasal mask defines, with the face, a chamber surrounding the mouth and nose of the wearer which receives air from the main volume of the respirator either through a plain aperture, or via a one-way valve. The main purpose of the oronasal mask is to manage the flow of exhaled air, in particular to prevent the build-up of exhaled air within the larger volume represented by the whole respirator.

The primary purpose of the respirator is to provide clean breathable air to the oronasal mask, or to the chamber serving the equivalent function of an oronasal mask, for inhalation by the wearer. For this purpose a protection factor (PF) is defined as the ratio of the quantity of harmful material present in the ambient atmosphere to that inside the respirator, specifically, inside the oronasal mask or equivalent chamber.

Two of the potential weaknesses which can affect the PF of a respirator are that the filter may not completely remove all of the harmful material and that the seal between the respirator and the wearer may allow contaminated air to enter the respirator and thus be available for inhalation by the wearer.

WO 03/068318 describes a respirator which addresses this problem by generating a small positive pressure within the respirator so that any leakage in the seal tends to result in air flowing out of the respirator, thus preventing potentially contaminated ambient air from flowing in. The positive pressure is generated by passing through a one-way valve a portion of the exhaled air from the oronasal mask.

The present invention addresses the problem by providing an additional filter for air entering the oronasal mask or equivalent chamber.

Thus, according to the invention there is provided a respirator for covering at least the face of the wearer and incorporating a visor positioned to enable the wearer to see, said respirator defining within a main volume into which air may be drawn from the exterior via a primary filter, and a secondary volume positioned so as to enclose the nose and mouth of the wearer, said respirator being characterised in that a secondary filter is provided to filter gas passing from the main volume to the secondary volume.

The secondary volume is generally defined by an oronasal mask, as described above, or a chamber, again as described above, which serves the equivalent function of an oronasal mask. For clarity the term oronasal mask will hereafter be used to describe both of these arrangements, but opinion in the industry is divided as to whether a chamber which is compartmentalised out of a larger volume should correctly be described as an oronasal mask. Notwithstanding this, the preferred form of oronasal mask for use with the present invention is one which is constructed essentially separately from the rest of the respirator and, in particular, has its own seal, separate from that of the respirator itself, which defines, with the wearer's face, the aforesaid second volume.

Preferably means are provided for sealing the secondary volume from the main volume so that substantially all air passing between the main volume and the secondary volume has to pass through the secondary filter. In the case of an oronasal mask, for example, such sealing means may be realised by the provision of a resilient seal along the locus of contact between the oronasal mask and the wearer's face.

The main volume is usually defined as the rest of the internal volume of the respirator. Where the respirator is a mask or hood, this volume is limited by the seal around the perimeter of the wearer's face, or around the wearer's neck; where the respirator is a whole body suit, then the main volume may comprise the whole volume of the suit, excepting only the oronasal mask.

The main volume is connected to the surrounding ambient air via an inlet port to which is fitted said primary filter, which acts to filter the air entering the main volume from the exterior. Any type of suitable filter may be used; the particular type employed will primarily be dictated by the particular harmful elements the respirator is required to guard against. Thus the filter may be operable to remove harmful material in vapour form or in the form of solid or liquid elements in suspension in the ambient air. The filter may include multiple filter elements in series, either for increased effectiveness, and/or to remove multiple different forms of harmful material.

A one-way valve is preferably associated with the inlet port, being fitted in such a way as to allow air into the main volume from the exterior, but not in the reverse direction. Such valves are well-known, and generally comprise a simple flap of elastomeric material such as silicone rubber or butyle rubber which is arranged to normally close off the port, but which will lift to allow air into the main volume.

Generally speaking the one-way valve is positioned on the downstream side of the primary filter.

The air to be inhaled by the wearer is passed from the main volume to the secondary volume via the aforesaid secondary filter. A further one-way valve is fitted in the air flow from the main volume into the secondary volume, being positioned preferably on the downstream side of the secondary filter. This further one-way valve may, for example, be a simple flap valve such as described above.

The above comments regarding the filtration characteristics of the primary filter apply also to the secondary filter. The two filters—primary and secondary—may be arranged to filter the same types of harmful material, or may be arranged to filter different types of harmful material. However, in considering the characteristics of the secondary filter, it must be borne in mind that the secondary filter does not simply collect air which has already passed through, and therefore been filtered by, the primary filter, but may also be required to filter air which has leaked in via the seal or via other leaks in the respirator, and will not therefore have been filtered at all.

The oronasal mask is preferably fitted with an exhale valve through which exhaled air is expelled to the exterior. The exhale valve may be conventional, and may comprise a one-way flap valve such as described above.

In a preferred embodiment of the invention the components of the respirator are positioned such that the incoming filtered air passes across the visor in its passage from the inlet port to the oronasal mask. This enables the incoming air to demist the visor. For this purpose, it is preferably arranged that said secondary filter is fitted in a conduit whose outlet passes into the secondary volume, and whose input is positioned on the opposite side of the respirator from the inlet port, so that air entering at the inlet port has to pass across the main respirator in order to enter the inlet to the conduit. In the preferred embodiment, this conduit is arranged in the chin area of the respirator, beneath the oronasal mask, and acts as a complete or partial blockage to the passage of air across the lower part of the mask. Air passing from the inlet port to the conduit thus preferentially flows over the top of the oronasal mask—in other words, across the visor.

Although described below in relation to a manual respirator, in the sense that the wearer supplies, through the power of his or her lungs, the suction required to draw air into the respirator, and hence into the wearer's lungs via the oronasal mask, the principles of the invention may also be applied to a respirator in which breathable air is supplied to the respirator under pressure, thus reducing the breathing load for the wearer. The filter in this case may be mounted on the respirator, otherwise worn by the user or remotely mounted.

In order that the invention may be better understood, an embodiment thereof will now be described by way of example only and with reference to the accompanying drawings in which:—

Figure 1:
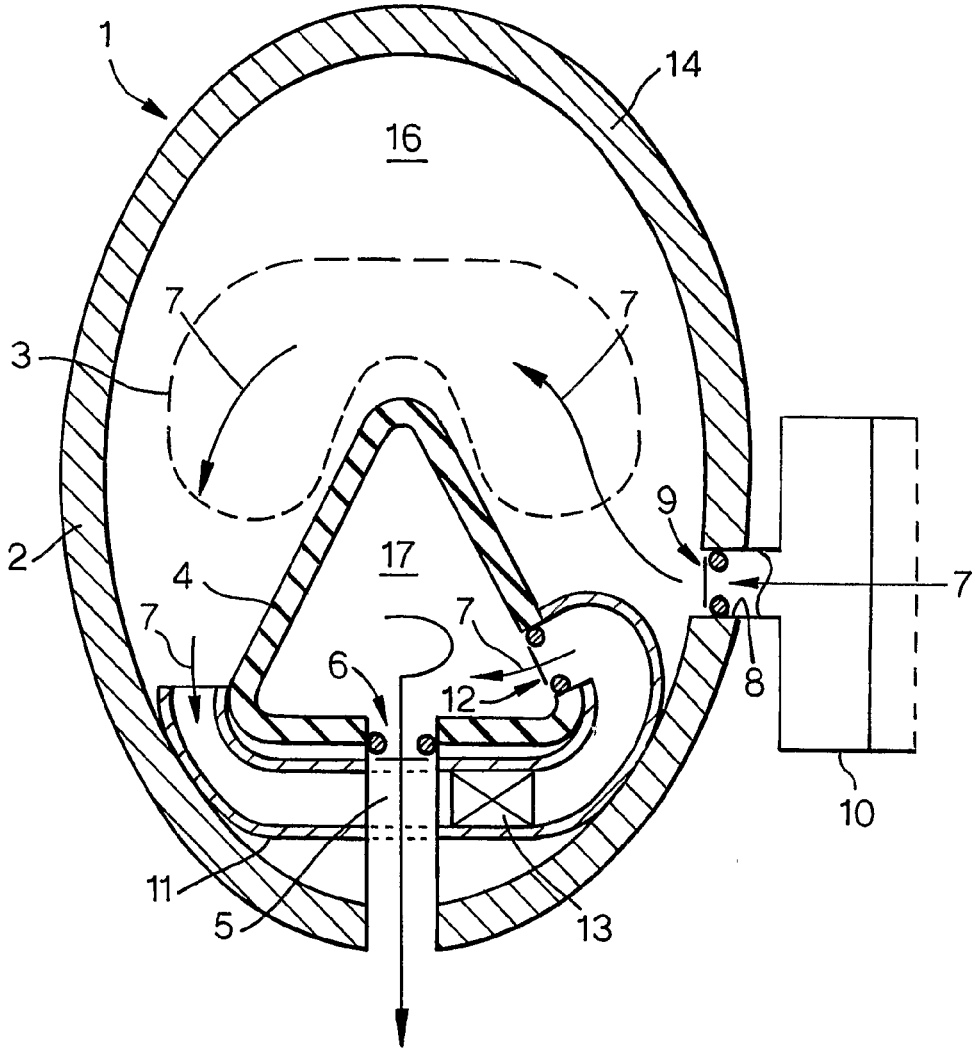
FIG. 1 is a diagrammatic view of a respirator in the form of a full-face mask, intended to illustrate the principles of the invention.
Figure 2:
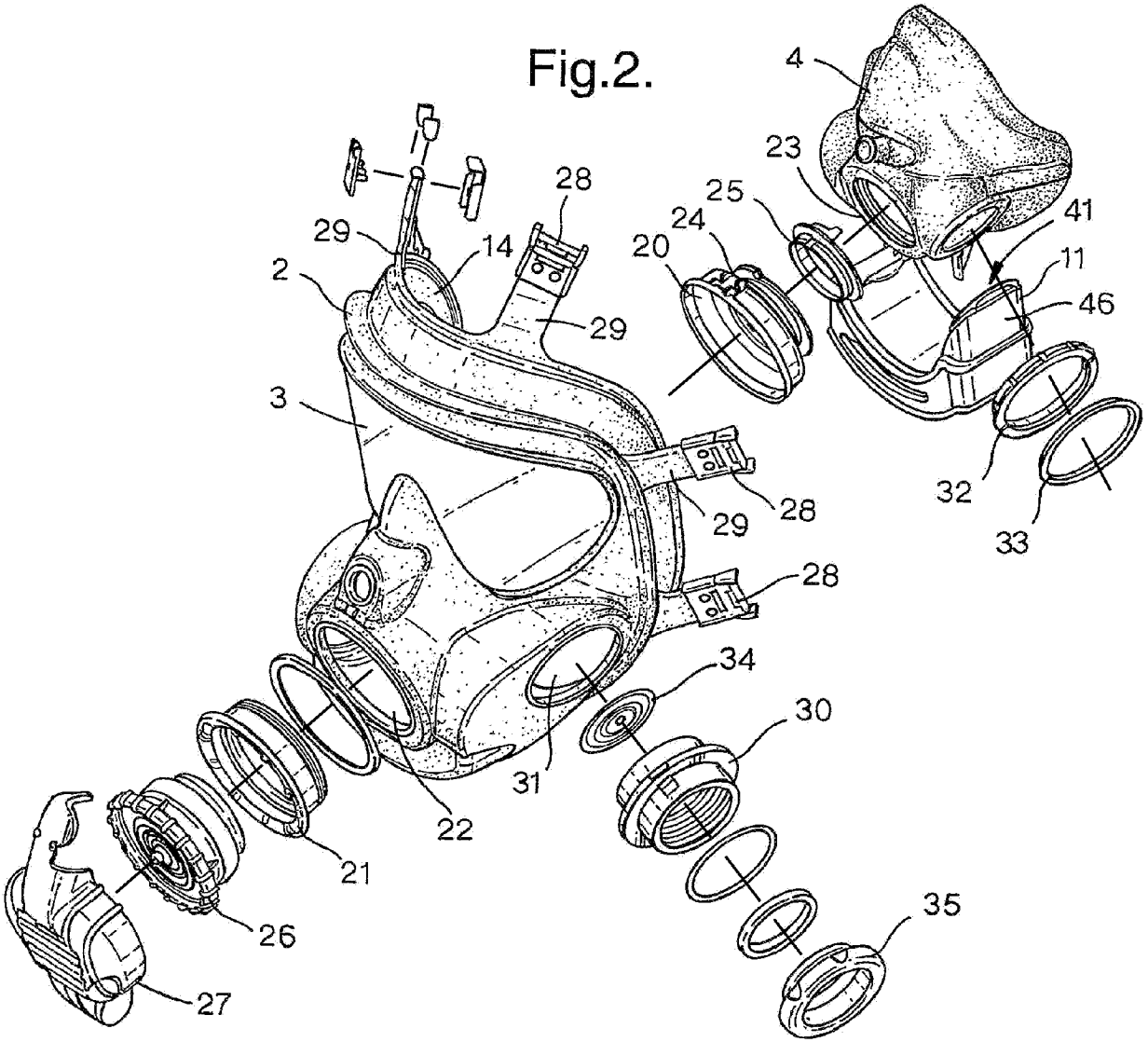
FIG. 2 is an exploded perspective view of one embodiment of a respirator, in the form of a full-face mask, constructed in accordance with the invention.

Reference is firstly made to FIG. 1 which is a diagram to illustrate the principles of the invention. The respirator is represented as a full face mask 1 comprising an outer mask 2 intended to seal around the perimeter of a wearers face and having a transparent visor whose position is represented by the dotted outline 3. An oronasal mask 4 is located within the outer mask 2 and is equipped with a conventional exhale conduit 5 fitted with an exhale valve 6. The valve 6 is such as to allow exhaled gas to exit from the oronasal mask to the exterior, but to prevent potentially contaminated air from the outside from passing into the mask.

Air 7 for breathing enters the outer mask 2 via an inlet port 8 fitted with a one-way valve 9 and a filter 10. The filter 10 contains one or more filter elements designed to filter either particulate or vapour challenges from the incoming air, or a mixture of these, as required.

The incoming air passes preferentially across the upper part of the outer mask, across the visor, as represented by the arrows 7. The air then enters the input of a conduit 11 by which the air is passed back in a direction towards the input port 8, and enters the oronasal mask 4 via a one-way valve 12.

Mounted within the conduit 11 is a secondary filter 13 which filters the incoming air as it passes into the oronasal mask 4. The filter 13 may be such as to filter either particulate or vapour challenges, or a mixture of these, as required.

When in use, the outer mask 2 and oronasal mask 4 bear against the wearer's face by means of respective seals 14,15 made of elastomeric material. It will be noted that the two seals are independent of one another, the oronasal seal 15 being contained wholly within the outer mask seal 14. This is the preferred form but, in another variant, the outer mask is compartmentalised to form the oronasal mask with the oronasal mask sharing some of its seal with that of the outer mask. This variant is less desirable however since it means that isolation of the oronasal mask from the ambient air is compromised.

In the embodiment illustrated, the seals 14,15 define, with the face, two separate volumes, referred to as the main volume 16 and the oronasal volume 17 respectively. The oronasal volume 17 is located wholly within the main volume 16 and is sealed therefrom, which means that the oronasal volume is doubly isolated from the ambient air. Leaving aside possible leakages of the seal 15, air can pass from the main volume 16 to the oronasal volume 17 only via the conduit 11, where it is filtered by secondary filter 13. Likewise leaving aside possible leakage of the seal 14, air can pass from the exterior to the main volume 16 only via the filter 10. The secondary filter 13 can thus be said to augment the filter 10, or primary filter, by being, in effect, connected in series with it. This assumes however that the seals, particularly the outer seal 14, are 100% effective which is unlikely to be the case; in practice air will leak across the outer seal 14, particularly during inhalation when there will be a slight negative, pressure within the main volume 16 which will tend to draw air in. Thus, in practice, the air passing through the secondary filter 13, whilst comprising mainly air which has been filtered by filter 10, will also comprise a small proportion of potentially contaminated air which has leaked in across outer seal 14 and has thus not been filtered.

It will be noted that the provision of a completely separate oronasal volume within the main volume maximises the wearer's protection against small amounts of contaminated air in the main volume since such contaminated air still has to pass across the oronasal seal 15 before it can become a danger to the wearer.

Air for breathing is drawn into the mask by the action of the wearer inhaling which causes a pressure drop in the oronasal mask and draws air in through the filter conduit 11 and ultimately through the inlet port 8 via filter 10. In so doing, the incoming air passes across the visor 3, thus helping to demist the visor. The moisture-laden exhaled air does not enter the main volume 16 (except by leakage across seal 15) and exits directly to the exterior via the conduit 5.

A practical embodiment of the invention, utilising the principles explained with reference to FIG. 1, will now be described with reference to FIGS. 2 to 6. Where appropriate, the same reference numerals have been used for the corresponding parts.

FIGS. 2 to 6 show a respirator in the form of a full face mask 1 comprising an outer mask 2 having a transparent visor 3, and an oronasal mask 4. Fitted below the oronasal mask 4 is a filter conduit 11, housing the secondary filter (not visible), and the assembly of the oronasal mask 4 and conduit 11 are fitted within the outer mask 2 by a front fitting comprising a cylindrical exhale cartridge housing 20 and corresponding cylindrical locknut 21 which screw together through a front aperture 22 in the outer mask 2. The oronasal mask 4 has a corresponding front aperture 23 which is sealingly fitted over a flange 24 on the housing 20. An optional coarse mesh filter 25 may be fitted within the housing 20, this being to prevent liquid or mucus ejected by the wearer from clogging the exhale valve. The exhale valve 6 is located in a cylindrical housing 26 which is detachably fitted to the front of the housing 20. A louvred cover 27 is fitted to the housing 26 to define a dead space downstream of the exhale valve to prevent lifting of the valve in certain adverse conditions.

Thus it will be seen that an exhale path is defined from the interior of the oronasal mask 4 direct to the exterior without entering the main volume defined by the outer mask 2.

The mask is held on the wearer's head by means of straps (not shown) which engage with buckles 28 mounted on short straps 29 of elastomeric material attached to the outer mask 2. These fittings are conventional and will not be described further.

The outer mask 2 seals against the perimeter of the wearer's face by means of a flexible seal 14 made of elastomeric material. The purpose of this seal is to create within the outer mask 2 a main volume 16 of air which is as airtight as possible. However, it is impossible to design a seal which will provide a 100% effective seal against all shapes of face and in all circumstances, so potential leakage of this seal has to be catered for. In the present mask, this is addressed by defining, within the main seal 14, a secondary seal 15 by which the oronasal mask 4 is sealed against the wearer's face. Thus contaminated air in the ambient atmosphere has to jump both seals before it can become a danger to the wearer. The shape and position of seals 14 and 15 is clearly shown in FIG. 3, which is a view looking into the interior of the mask.

Air to be inhaled is drawn into the mask by the action of the wearer inhaling which causes negative pressure to be created within the oronasal mask, and hence within the main volume 16 of the outer mask, as described previously. This in turn draws air in through an inlet port in the form of an inlet valve housing 30 which is screwed through a side aperture 31 in the outer mask 2 and retained with a nut 32 and washer 33. A flap valve 34 is mounted within the housing 30 to create the aforesaid one-way inlet valve 9. The housing 30 is equipped with a fitting 35 suitable to removably attach a cartridge-type filter (not shown).

Figure 5:
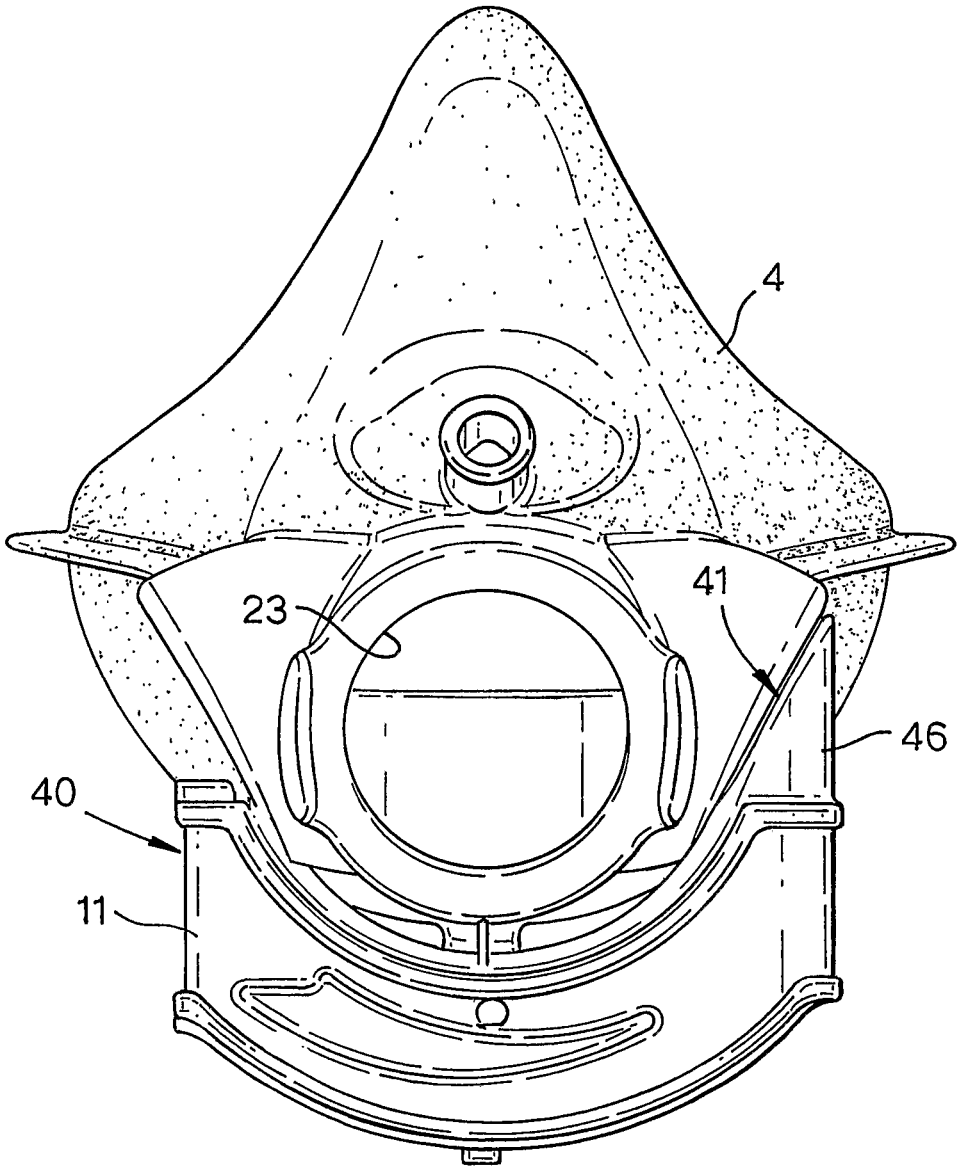
FIG. 5 is a front view of the oronasal mask and attached filter assembly, as fitted to the mask of FIG. 2.
Figure 6:
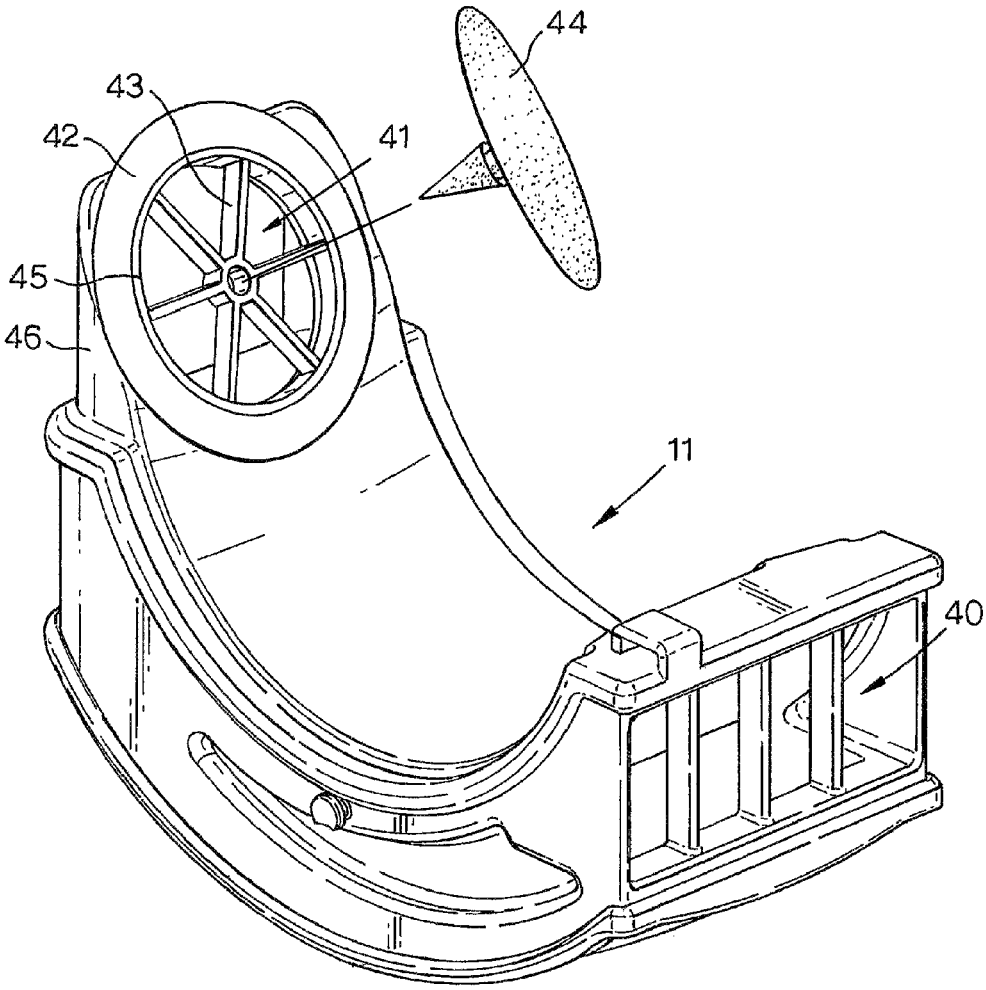
FIG. 6 is a perspective view from the rear and above of the filter assembly fitted to the oronasal mask of FIG. 5.

Particular reference is now made to FIGS. 5 and 6 which illustrate the oronasal mask 4 and secondary filter conduit 11. The conduit 11 has a generally curved shape defining, at one end, an inlet 40 for incoming air and, at the other end, an outlet 41 for air entering the oronasal mask. The outlet 41 is formed with a flange 42 whereby, in association with a corresponding annular groove formed in the oronasal mask 4, the conduit 11 may be physically mounted underneath the oronasal mask to form the assembly illustrated in FIG. 5.

The outlet 41 is also formed with an open framework 43, on which is mounted through a central aperture a flap valve element 44 made of elastomeric material such as silicone rubber or butyle rubber. The arrangement is such that, in its normal position, the valve element seals the outlet 41 by resting against a slightly raised annular rim 45 but will flap open if air is drawn into the conduit 11 through its inlet 40. Thus the element 44 forms, with the associated structure, the aforesaid one-way flap valve 7, allowing air to flow through the outlet 41 and into the oronasal volume 17, but not in the reverse direction. The one-way exhale valve 6 and inlet valve 9 are constructed in a similar way.

Situated within the conduit 11 is a filter positioned to filter all air passing from the inlet 40 to the outlet 41 of the conduit. The nature of this filter has already been discussed. The filter element or elements may be removable but, more likely, the whole conduit 11 will be replaced when the filter needs changing.

Figure 3:
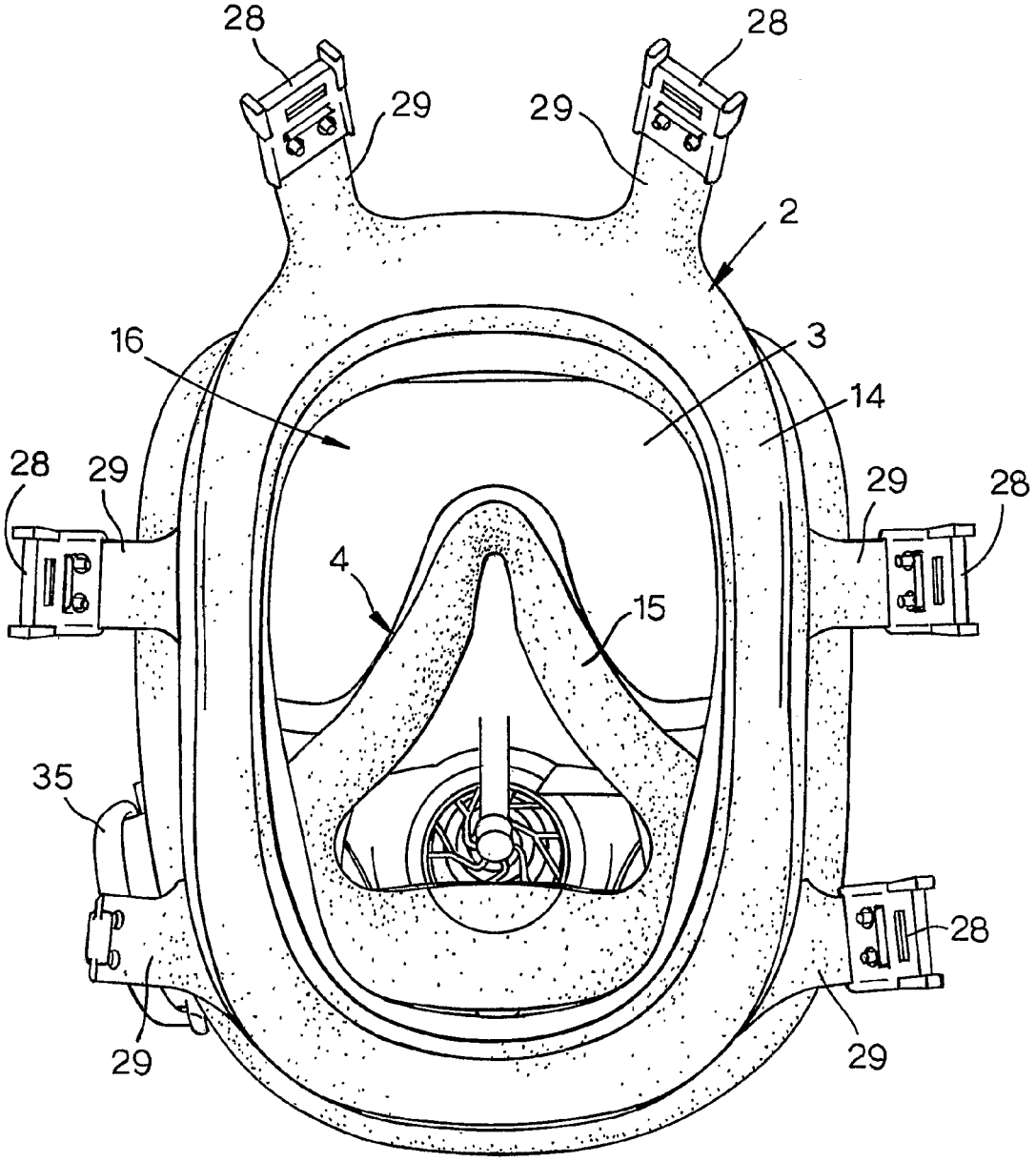
FIG. 3 is a view looking into the interior of the mask of FIG. 2.
Figure 4:
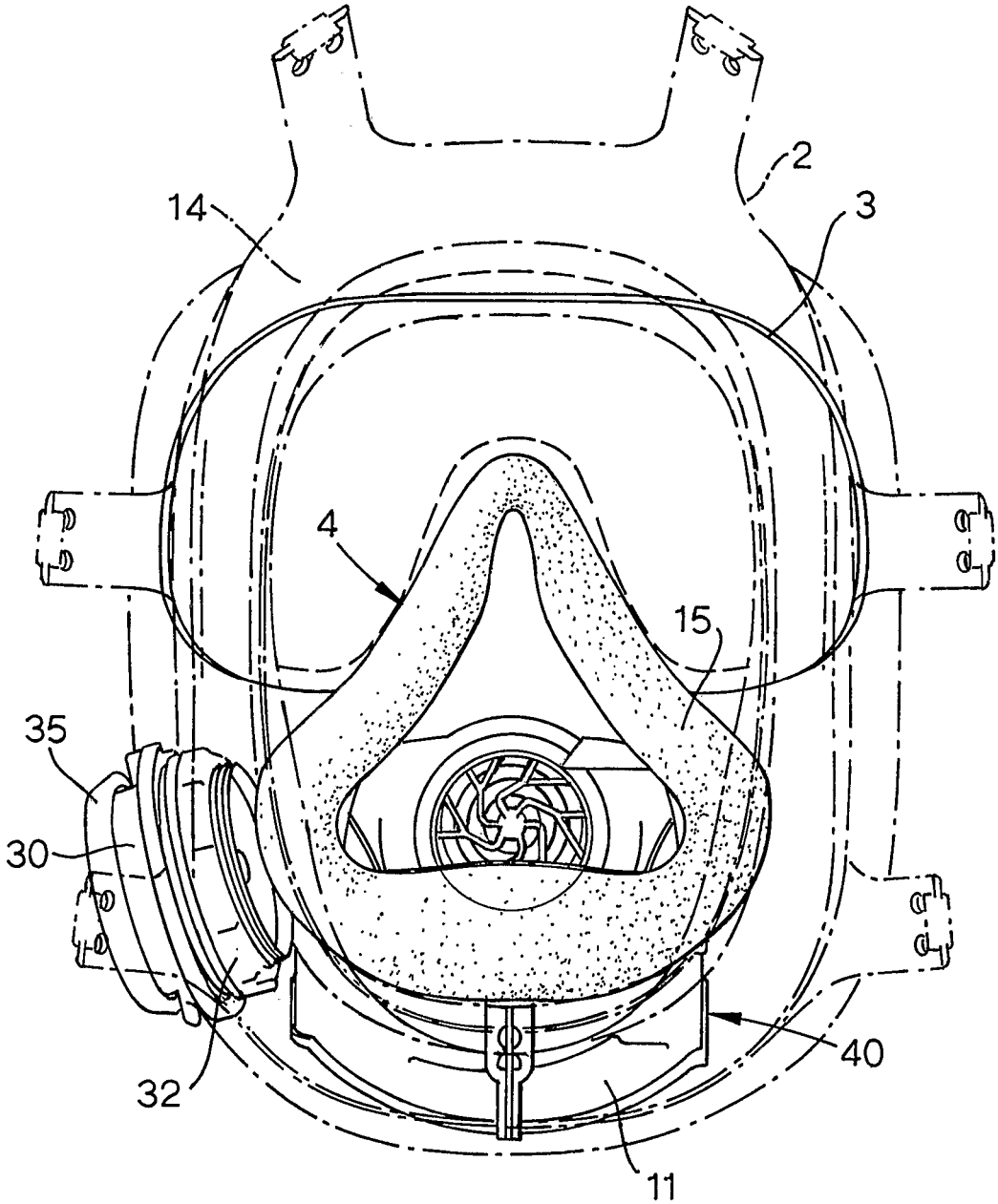
FIG. 4 is a view similar to FIG. 3, but in which the outer parts of the mask are shown dotted in order to reveal some features of the mask interior not clearly visible in FIG. 3.

Particular reference is now made to FIG. 4 which shows the same view as FIG. 3, but in which the outer mask 2 is shown in dotted outline, enabling more of the interior detail to be visible. Input air enters through the main filter (not shown) through the cylindrical housing 30 containing one-way valve 9 and into the interior of the outer mask 2. Immediately opposite the exit to the housing 30 is the upstanding part 46 of the conduit 11 (FIG. 5) which leads to the outlet 41; however, the inlet air cannot enter the conduit 11 at this point and is instead directed across the main volume 16 of the outer mask to enter the conduit at the inlet 40 situated on the right-hand side (when seen in FIG. 4). It will be seen that the arrangement of the oronasal mask 4 and conduit 11 within the main volume 16 is such that the incoming air, in passing from the left side to the right side of the main volume, when seen in FIG. 3, preferentially flows across the top of the oronasal mask, and thus across the visor 3, instead of taking a route beneath the oronasal mask 4 which is substantially blocked by the presence of the conduit 11. For this purpose the conduit 11 and inner surface of the outer mask 2 in this area are given an approximately corresponding shape to enhance this effect. As already explained, this flow of air across the mask effectively demists the visor.

Other details of the operation of the mask described with reference to FIGS. 2 to 6 will not be repeated because it will be readily understood with reference to the description of FIG. 1, already given.

The invention claimed is:

1. A respirator comprising:

an outer mask defining a first volume and having a chin area at a bottom region of the outer mask;

an oronasal mask defining a second volume, the oronasal mask being positioned within the first volume;

a primary filter, the primary filter being affixed to the outer mask;

a conduit, the conduit having a first end and second end distal the first end, the first end of the conduit being open to the first volume and allowing air to flow from the first volume into the second volume, the conduit having at least a portion positioned in the chin area of the outer mask; and a secondary filter positioned within the conduit and within the chin area.

2. The respirator as claimed in claim 1 wherein the secondary filter filters air traveling around a portion of the second volume, the secondary filter having a filter inlet for receiving air and a filter outlet for outputting air.

3. The respirator as claimed in claim 2, further comprising a visor positioned within the first volume such that air traveling around the secondary volume passes proximate the visor.

4. The respirator as claimed in claim 1 further comprising a primary inlet port allowing air to be drawn into the first volume from the primary filter, the primary inlet port positioned on the outer mask.

5. The respirator as claimed in claim 4 further comprising a one-way valve allowing air to travel from the primary inlet port to the first volume, the one-way valve preventing air from traveling into the primary filter from the first volume.

6. The respirator as claimed in claim 5 wherein said one-way valve accepts air flowing from the primary filter.

7. The respirator as claimed in claim 1 further comprising a one-way valve allowing air to travel into the secondary volume from the first volume, the one-way valve prevents air from traveling into the first volume from the secondary volume.

8. The respirator as claimed in claim 7 wherein said one-way valve accepts air traveling from the secondary filter.

9. The respirator as claimed in claim 1 wherein the conduit is entirely disposed within the first volume.

10. The respirator as claimed in claim 1 further comprising an exhale valve allowing air to travel from the secondary volume to the exterior of the outer mask.

11. The respirator as claimed in claim 1 wherein the oronasal mask is arranged to form a seal against a wearer's face such that the secondary volume forms a separate self contained volume within the first volume when sealed against the wearer's face.

12. The respirator as claimed in claim 1, wherein the outer mask further includes a visor, and wherein the conduit is arranged to cause air to flow across the visor and into the first end of the conduit.

13. A respirator comprising:

an outer mask defining a first volume, the outer mask having a visor and having a chin area at a bottom region of the outer mask;

an oronasal mask defining a second volume, the oronasal mask being positioned within the first volume;

a primary filter, the primary filter being affixed to the outer mask;

a filter conduit, the filter conduit having a first end and second end distal the first end, one of the first end and second end of the filter conduit being open to the first volume; and a secondary filter positioned within the filter conduit and within the chin area, the secondary filter configured to filter air traveling around at least a part of the oronasal mask from the first volume into the second volume.

14. The respirator of claim 13, wherein the other of the first end and second end of the filter conduit is coupled to the oronasal mask.

15. A respirator comprising:

an outer mask defining a first volume and having a bottom;

an oronasal mask defining a second volume, the oronasal mask being positioned within the first volume a primary filter, the primary filter being affixed to the outer mask;

a filter conduit, at least a portion of the filter conduit being positioned between the oronasal mask and the bottom of the outer mask, the filter conduit having a first end and second end distal the first end, one of the first end and second end of the filter conduit being open to the first volume; and a secondary filter, the secondary filter positioned within the filter conduit, the secondary filter filtering air traveling from the first volume to the second volume.

16. The respirator of claim 15, wherein the outer mask further includes a visor, and wherein the filter conduit is arranged to cause air to flow across the visor and into the one of the first end and second end of the filter conduit open to the first volume.

* * * * *